US005335520A

United States Patent [19]

Lee

[11] Patent Number: 5,335,520

[45] Date of Patent: Aug. 9, 1994

[54] FLAT LOCK

[76] Inventor: Miko Lee, No. 5, Li Hsing Hsiang, Chung Cheng Rd., Hsin Chuang City, Taipei Hsien, Taiwan

[21] Appl. No.: 25,180

[22] Filed: Mar. 2, 1993

[51] Int. Cl.[5] ..... E05B 21/06

[52] U.S. Cl. ..... 70/349; 70/491; 70/365; 70/369; 70/340; 70/389; 70/377; 70/401

[58] Field of Search ..... 70/349, 490, 491, 492, 70/365, 366, 389, 392, 377, 340, 369, 375, 401

[56] References Cited

U.S. PATENT DOCUMENTS

| | | | |
|---|---|---|---|
| 89,197 | 4/1869 | Brettell | 70/491 |
| 461,200 | 10/1891 | Kahlke | 70/349 |
| 3,509,748 | 5/1970 | Trainor | 70/389 |
| 4,967,578 | 11/1990 | Sheu et al. | 70/491 |

FOREIGN PATENT DOCUMENTS

| | | | |
|---|---|---|---|
| 567720 | 1/1993 | Fed. Rep. of Germany | 70/491 |
| 2426135 | 1/1980 | France | 70/377 |

*Primary Examiner*—Peter M. Cuomo
*Assistant Examiner*—Darnell M. Boucher
*Attorney, Agent, or Firm*—Woodcock Washburn Kurtz Mackiewicz & Norris

[57] ABSTRACT

A flat lock set has a flat lock having a cylinder, a tumbler, several rings and springs and a key having several stepped blades each having several shoulders. The cylinder is mounted in a door and has four groups of ribs formed therein. Each group includes several separate ribs defining several passages extending perpendicular to a length of the cylinder. The cylinder has a first end defining a first opening and a second end integrating with a ring defining a second opening. The tumbler has a disk integrating with a key receiver integrating with a latch carrier. The key carrier is separated into several prongs. The rings each have two ears formed along an outer rim thereof and several arms formed along an inner rim thereof. When the rings and springs are alternatively mounted on the first sections of the prongs, the arms formed on the rings are sited between the prongs. The tumbler is assembled in the cylinder with the second sections of the prongs thereof protruding through the second opening for carrying a latch. The springs bias the rings toward the disk of the tumbler so that the ears protruding from the rings are trapped between the ribs. The shoulders formed on the blades of the key press the arms so that the ears align with the passages.

3 Claims, 6 Drawing Sheets

FLAT LOCK

BACKGROUND OF INVENTION

1. Field of Invention

The present invention relates to a flat lock.

2. Related Prior Art

Conventional flat locks each have a cylinder mounted in a door or the like, a tumbler co-axially pivotably mounted in the cylinder and a latch co-axially pivotably mounted on the tumbler. The cylinder has an inner surface on which a number of separate longitudinal ribs are formed. The tumbler has a number of slots transversely formed therein. The slots each communicate with a relatively wide cylindrical recess at a terminal portion thereof. Four springs are respectively received in the cylindrical recesses. Four strips each have a first tip, a second tip, a relatively small ear transversely formed thereon and a slot longitudinally formed therein. The strips are received respectively in the slots defined in the tumbler. When the strips are respectively received in the slots formed in the tumbler, the ears protruding therefrom are sited against the springs so that the first tips of the strips are biased out of the tumbler by means of the springs. The first tips of the strips are trapped between two adjacent ribs formed on the inner surface of the cylinder so that the tumbler, together with the latch, is restrained from pivoting relative to the cylinder. The slots formed in the strips align with one another when the strips are mounted in slots formed in the tumbler so that a key is insertable therethrough. The slots formed in the strips differ from one another in length so that the first tips of the strips are urged into the tumbler when the key is inserted through the slots defined in the strips, i.e., the first tips of the strips are not trapped between two adjacent ribs formed on the inner surface of the cylinder. Thus, the tumbler is permitted to pivot with respect to the cylinder. Thus, the latch is permitted to pivot relative to the cylinder. But, the flat locks can be easily picked by inserting a slender element through the slots defined in the strips and pressing strips toward the second tips thereof so that the first tips thereof are moved into the tumbler. Therefore, the present invention is intended to solve the above-mentioned problem.

SUMMARY OF INVENTION

It is an object of the present invention to provide a flat lock set consisting of a flat lock and a key. The flat lock has a cylinder, a tumbler, several rings and springs. The cylinder has a threading formed on an outer surface thereof for securing the flat lock in a door or the like and several groups of ribs formed on an inner surface thereof. Each group includes several separate ribs, defining a number of passages extending perpendicular to a length of the cylinder. The cylinder has a first end defining a first opening and a second end integrating with an annular portion defining a second opening. The first opening has a diameter greater than that of the second opening. The tumbler has a disk integrating with several prongs each consisting of a first section and a relatively slender second section. The first sections of the prongs are inserted in the cylinder while the second sections of the prongs protrude through the second opening. The disk defining a keyhole fits in the first opening so that the tumbler is joined together with the cylinder. The second sections of the tumbler carry a latch. The rings each have two ears formed along an outer rim thereof and several arms formed along an inner rim thereof. While the rings and springs are alternatively mounted on the first sections of the prongs, the arms formed on the rings are sited between the first sections of the prongs. The springs bias the rings toward the disk of the tumbler so that the ears of the rings are trapped between the ribs. The key has several stepped blades each having several shoulders formed thereon. When the blades of the key are inserted between the first sections of the prongs of the tumbler, the shoulders formed thereon push the rings so that the ears protruding from the rings align with the passages. The arms formed on the rings are permitted to travel along the passages. The rings, together with the tumbler, are permitted to rotate.

It is another object of the present invention to provide a flat lock system including a number of different flat locks requiring a corresponding number of different keys. A master key matches all of the different flat locks.

For a better understanding of the present invention and objects thereof, a study of the detailed description of the embodiments described hereinafter should be made in relation to the accompanying drawings.

DETAILED DESCRIPTION OF PREFERRED EMBODIMENT

The present invention will be described in detail with reference to the drawings showing some embodiments thereof.

Figure 1:
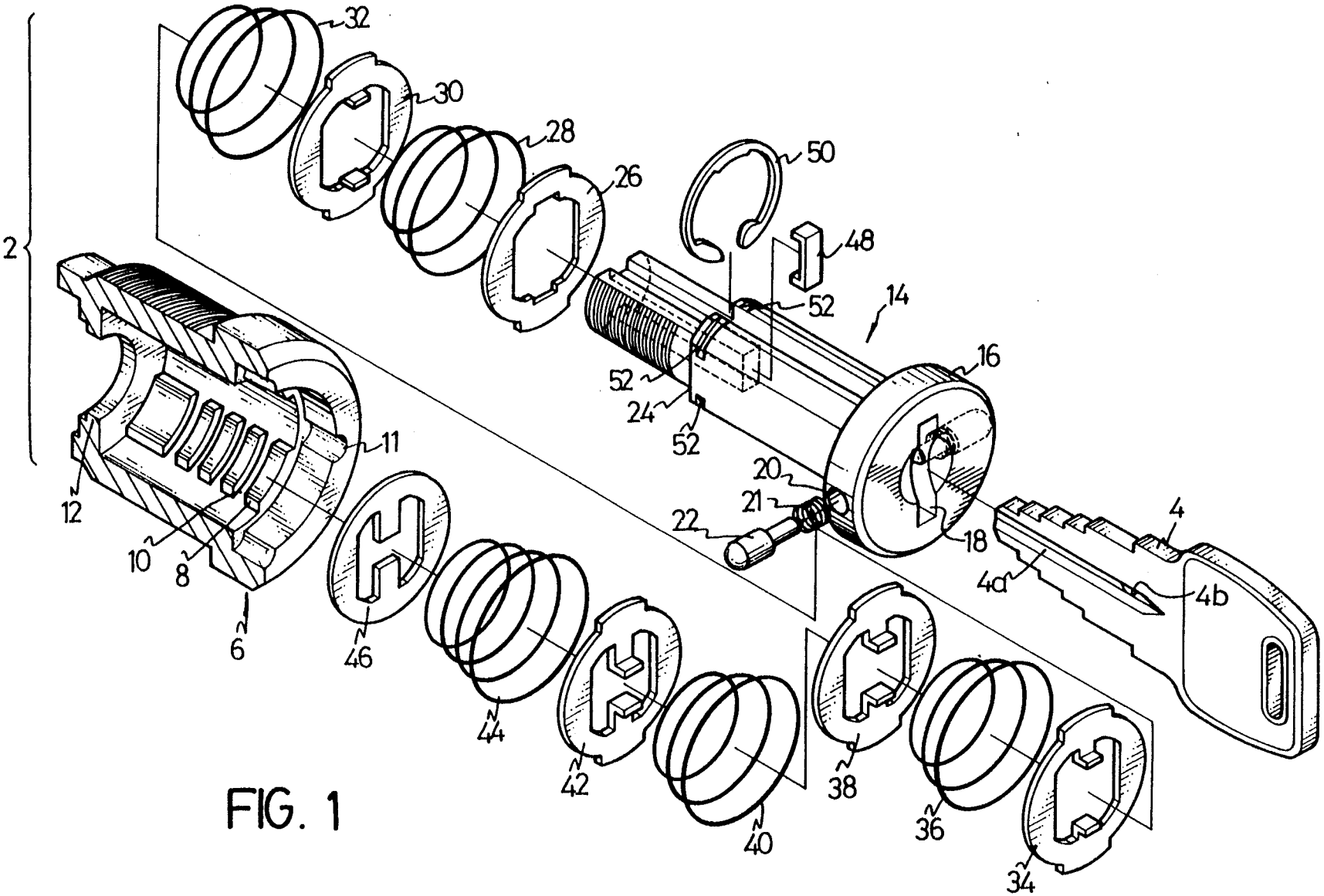
FIG. 1 is an exploded view of a flat lock set consisting of a flat lock and a key in accordance with a first embodiment of the present invention.

Initially referring to FIG. 1, in accordance with a first embodiment of the present invention, a flat lock set has a flat lock 2 and a key 4. The flat lock 2 is mounted in a door or the like (not shown) and is manipulated by means of the key 4.

The key 4 has two grooves **4*a* longitudinally formed therein and a hole 4*b*** transversely formed therethrough.

The key 4 has two blades each having a number of shoulders formed thereon.

The flat lock 2 has a cylinder 6 defining an outer surface and an inner surface. A threading is formed on the outer surface of the cylinder 6 for securing the flat lock 2 in the door. In accordance with the preferred embodiments of the present invention, four groups of ribs 8 are formed on the inner surface of the cylinder 6. Each group includes five separate ribs 8, defining four passages 10 extending perpendicular to a length of the cylinder 6. The cylinder 6 has a first opening formed in a first end thereof and a second opening formed in a second end thereof. The cylinder 6 has a number of shallow recesses 11 formed in the inner surface thereof within the first opening. The second opening is enclosed by an annular portion 12 formed on the inner surface of the cylinder 6. The first opening has a diameter larger than that of the second opening.

The flat lock 2 has a tumbler 14 pivotably mounted in the cylinder 6. The tumbler 14 has a stepped form having a disk 16 integrating with a relatively slender key receiver 24 integrating with a further relatively slender threaded latch carrier (not labelled). A slot is longitudinally formed in the key receiver 24, separating the key receiver 24 into two prongs. The key receiver 24 is substantially sited in the cylinder 6, with a small portion of the key receiver 24 protruding beyond the annular portion formed on the inner surface of the cylinder 6. At that instant, the disk 16 abuts an annular shoulder formed within the first opening and the latch carrier 25 completely protrudes through the second opening. A C-clip 50 engages in a number of grooves 52 formed in the portion of the key receiver 24 which protrudes beyond the annular portion formed on the inner surface of the cylinder 6. Thus, the tumbler 14 is kept from moving relative to the cylinder 6, the tumbler 14 is pivotally assembled in the cylinder 6.

Figure 3:
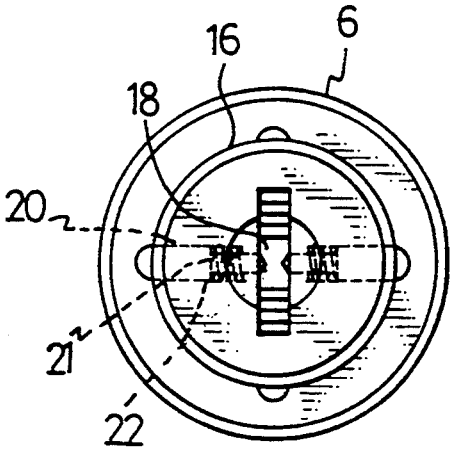
FIG. 3 is a front view of a flat lock in accordance with the first embodiment of the present invention.

Additionally referring to FIG. 3, the disk 16 has a keyhole 18 formed therethrough and two holes 20 radially formed therein. The keyhole 18 communicates with the holes 20. The holes 20 each have a stepped form with a first portion and a relatively slender second portion, forming a shoulder. A number of pins 22 each have a stepped form having a first portion with a domed tip and a relatively slender second portion with a pointed tip.

A number of springs 21 and the pins 22 are sequentially sited in the holes 20. The springs 21 are each compressed between the shoulder formed in a corresponding one of the holes 20 and a shoulder formed on a corresponding one of the pins 22. Normally, the domed tips of the pins 22 align with some of the shallow recesses 11. The domed tips of the pins 22 engage in some of the shallow recesses as the pins 22 are biased by means of the springs 21. At that instant, the pointed tips of the pins 22 only slightly protrude in the keyhole 18 so that the keyhole 18 is accessible.

To manipulate the flat lock 2, the key 4 is inserted through the keyhole 18. The pointed tips of the pins 22 engage in the grooves 4*a*. The pointed tips of the pins 22 align with the hole 4*b* when the key 4 is completely inserted in the tumbler 14. The disk 16, together with the pins 22, is pivoted with respect to the cylinder 6 as the key 4 is pivoted. The domed tips of the pins 22 are disengaged from the shallow recesses 11. The inner surface of the cylinder 6 pushes the pins 22 to move toward the keyhole 18. Accordingly, the pointed tips of the pins 22 project further into the keyhole 18 so that they protrude in the hole 4*b*. Therefore, the key 4 cannot be pulled out of the tumbler 14 unless the domed tips of the pins 22 are moved into some of the shallow recesses 11 again.

Further referring to FIG. 1, the flat lock 2 further has six rings 26, 30, 34, 38, 42 and 46 and springs 28, 32, 36, 40 and 44 alternatively mounted on the key receiver 24.

The ring 30 has two separate ears projecting from an outer rim thereof and two separate fingers protruding from an inner rim thereof. The ring 30 is co-planar with the ears protruding therefrom and is perpendicular to the fingers protruding therefrom. The rings 34, 38 and 42 each have two separate ears projecting from an outer rim thereof and two separate arms protruding from an inner rim thereof. The rings 34, 38 and 42 each are co-planar with the ears protruding therefrom and the arms protruding therefrom. The rings 34, 38 and 42 each further have a number of fingers respectively perpendicularly protruding from the arms protruding therefrom. The ring 46 has two arms protruding from an inner rim thereof and being co-planar therewith.

Figure 2:
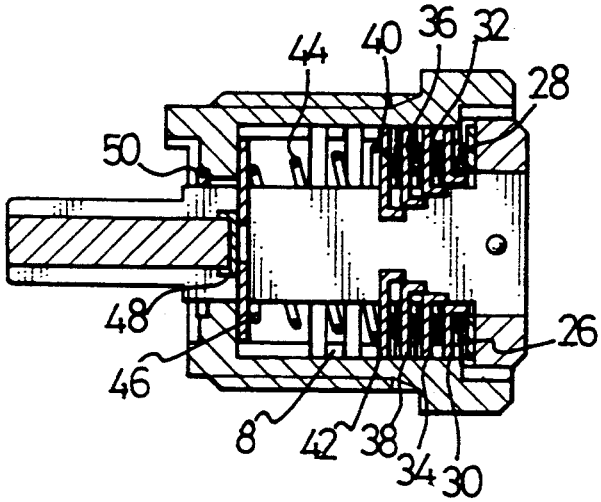
FIG. 2 is a cross-sectional view of a flat lock in accordance with the first embodiment of the present invention.

Additionally referring to FIG. 2, the thickness of the finger protruding from the ring 30 is equal to the length of the arms protruding from the ring 34. The length of the arms protruding from the ring 34 plus the thickness of the fingers protruding from the arms protruding from the ring 34 is equal to the length of the arms protruding from the ring 38. The length of the arms protruding from the ring 38 plus the thickness of the fingers protruding from the arms protruding from the ring 38 is equal to the length of the arms protruding from the ring 42. The length of the arms protruding from the ring 42 plus the thickness of the fingers protruding from the arms protruding from the ring 42 is equal to the length of the arms formed on the ring 46.

Initially, the ring 26 and spring 28 are sequentially mounted on the key receiver 24. The rings 30, 34, 38, 42 and 46 and the springs 28, 32, 36, 40 and 44 are alternatively mounted on the key receiver 24 while the arms protruding therefrom are sited in the slot formed in the key receiver 24. A U-shaped element 48 is sited in the slot formed in the key receiver 24. The U-shaped element 48 has a first side abutting the arms formed on the ring 46 and a second side engaging with the latch carrier 25. Thus, the rings 26, 30, 34, 38, 42 and 46 and the springs 28, 32, 36, 40 and 44 are retained on the key receiver 24 between the disk 16 and the U-shaped element 48.

The rings 26, 30, 34, 38, 42 and 46 are mounted on the key receiver 24 so that the key receiver 24 rotates synchronously with the rings 26, 30, 34, 38, 42 and 46. A latch (not shown) is mounted on the latch carrier.

Figure 4:
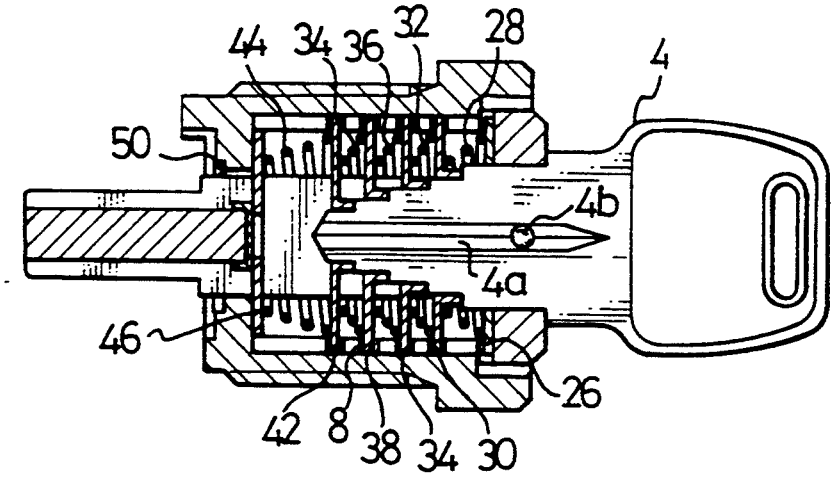
FIG. 4 is a cross-sectional view of a flat lock receiving a key in accordance with the first embodiment of the present invention.

Referring to FIGS. 3 and 4, the keyhole 18 aligns with the arms protruding from the rings 30, 34, 38, 42 and 46. The fingers protruding from the rings 30, 34, 38 and 42 are sequentially arranged, i.e., they are not concealed by one another. In vertical position, the shoulders formed on the key 4 respectively align with the fingers protruding from the rings 30, 34, 38 and 42. Thus, the shoulders formed on the key 4 abut the fingers protruding from the rings 30, 34, 38 and 42 when the key 4 is inserted through the key 18.

In original length, the springs 28, 32, 36 and 40 are shorter than the spring 44. The rings 30, 34, 38 and 42 are pushed toward the disk 16 by means of the springs 32, 36, 40 and 44 so that the ears of the rings 30, 34, 38 and 42 are trapped between the ribs 8. The tumbler 14, together with the latch, is prevented from pivoting.

In horizontal position, the shoulders formed on the key 4 match the combination of the passages 10 and the fingers protruding from the rings 30, 34, 38 ,and 42. When the blades of the key 4 are completely inserted in the flat lock 2, the shoulders formed on the key 4 push the fingers protruding from the rings 30, 34, 38 and 42 to a position so that the passages 10 align with the ears protruding from the rings 30, 34, 38 and 42 as shown in FIG. 4. The tumbler 14, together with the latch, is pivotable.

Figure 5:
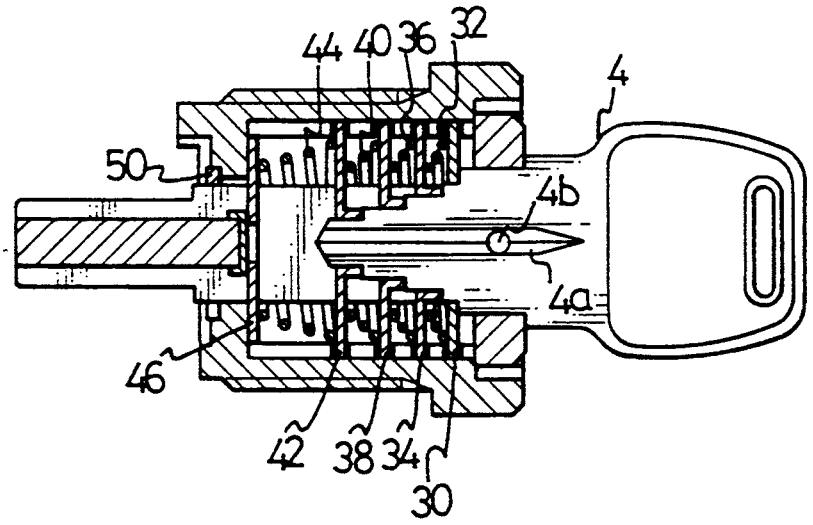
FIG. 5 is a cross-sectional view of a flat lock receiving a key in accordance with a second embodiment of the present invention.
Figure 6:
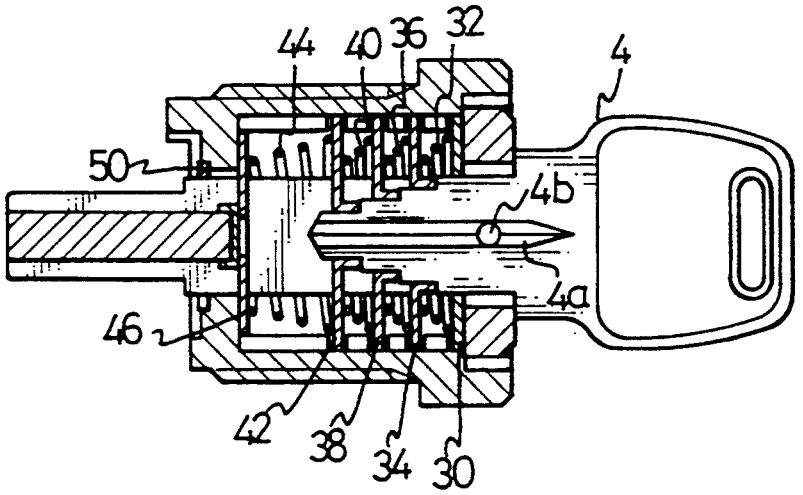
FIG. 6 is a cross-sectional view of a flat lock receiving a key in accordance with a third embodiment of the present invention.

FIGS. 5 and 6 respectively show the second and third embodiments of the present invention. Unlike the first embodiment, the distances between the passages 10 are different. Accordingly, the horizontal distances between the shoulders formed on the key 4 are different. In fact, various arrangements of the shoulders formed on the key 4 and the passages 10 are possible as far as the shoulders formed on the key 4 push the ears extending from the rings 30, 34, 38 and 42 in order to align with the passages 10 when the key 4 is completely inserted in the tumbler 14.

Figure 7:
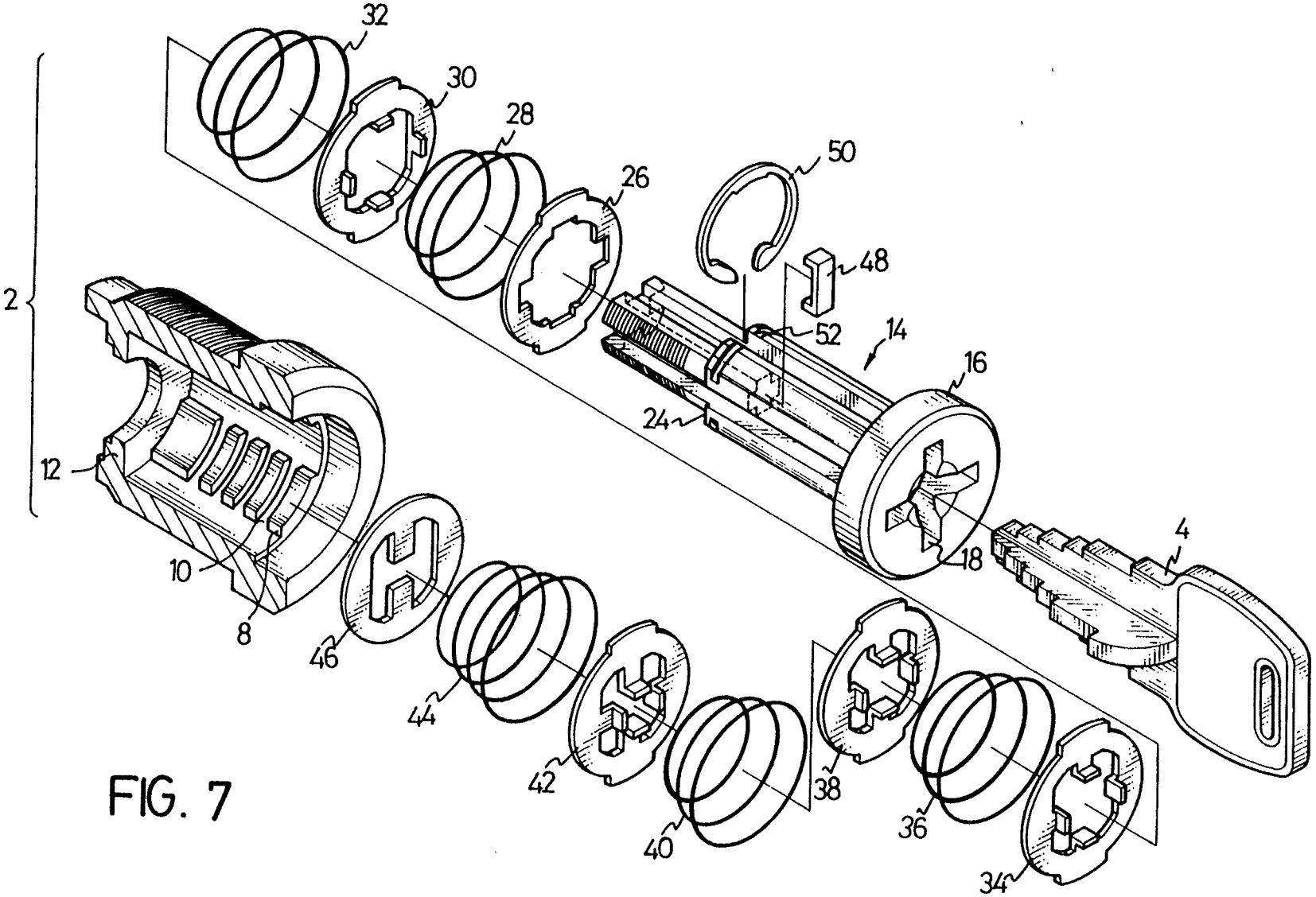
FIG. 7 is an exploded view of a flat lock set consisting of a flat lock and a key in accordance with a fourth embodiment of the present invention.

Referring to FIG. 7 showing a fourth embodiment of the present invention, the key 4 has four blades. The disk 16 defines a cruciform keyhole. The key receiver 24 is separated into four prongs by two intersecting slots. The rings 30, 34, 38 and 42 each have four arms. However, this embodiment is not described in detail as being substantially identical to the above-mentioned embodiments.

Figure 8:
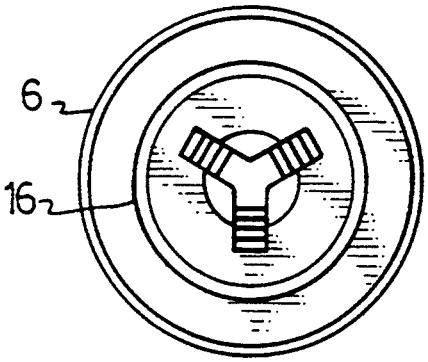
FIG. 8 is a front view of a flat lock in accordance with a fifth embodiment of the present invention.

Referring to FIG. 8 showing a fifth embodiment of the present invention, the disk 16 defines a keyhole consisting of three slots radially protruding from one common center. Although not shown, the key carrier 24 is separated into three prongs by three intersecting slots. The rings 30, 34, 38 and 42 each have three arms. The key 4 has three blades. However, this embodiment will not be described in detail as the remaining parts thereof are identical to the above-mentioned embodiments.

Figure 9:
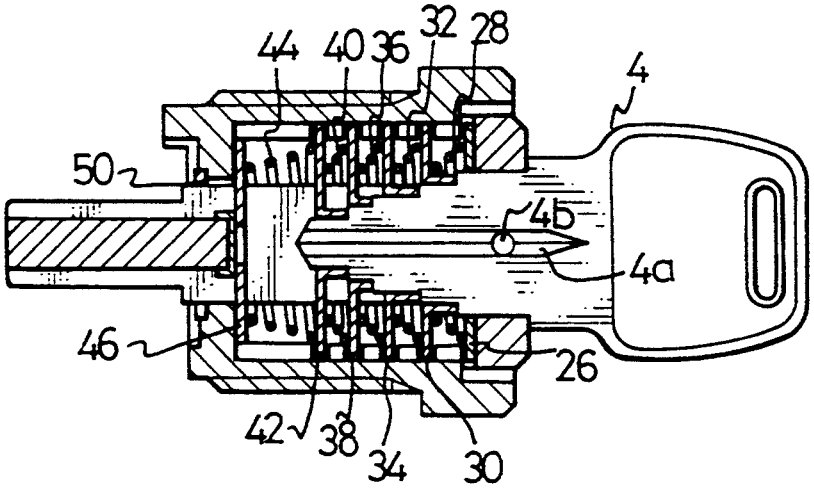
FIG. 9 is a cross-sectional view of a flat lock receiving a key in accordance with a sixth embodiment of the present invention.

FIG. 9 shows a sixth embodiment of the present invention. Like the first embodiment, the distances of the passages 10 are the same. Unlike the first embodiment, the fingers respectively extending from the rings 30, 34, 38 and 42 have different lengths. The horizontal distances between the shoulders formed on the key 4 are different. Obviously, different flat lock sets (each including a flat lock 2 and a key 4) are possible if the fingers extending from the rings 30, 34, 38 and 42 have different lengths although the distances between the passages 10 are the same.

Figure 10:
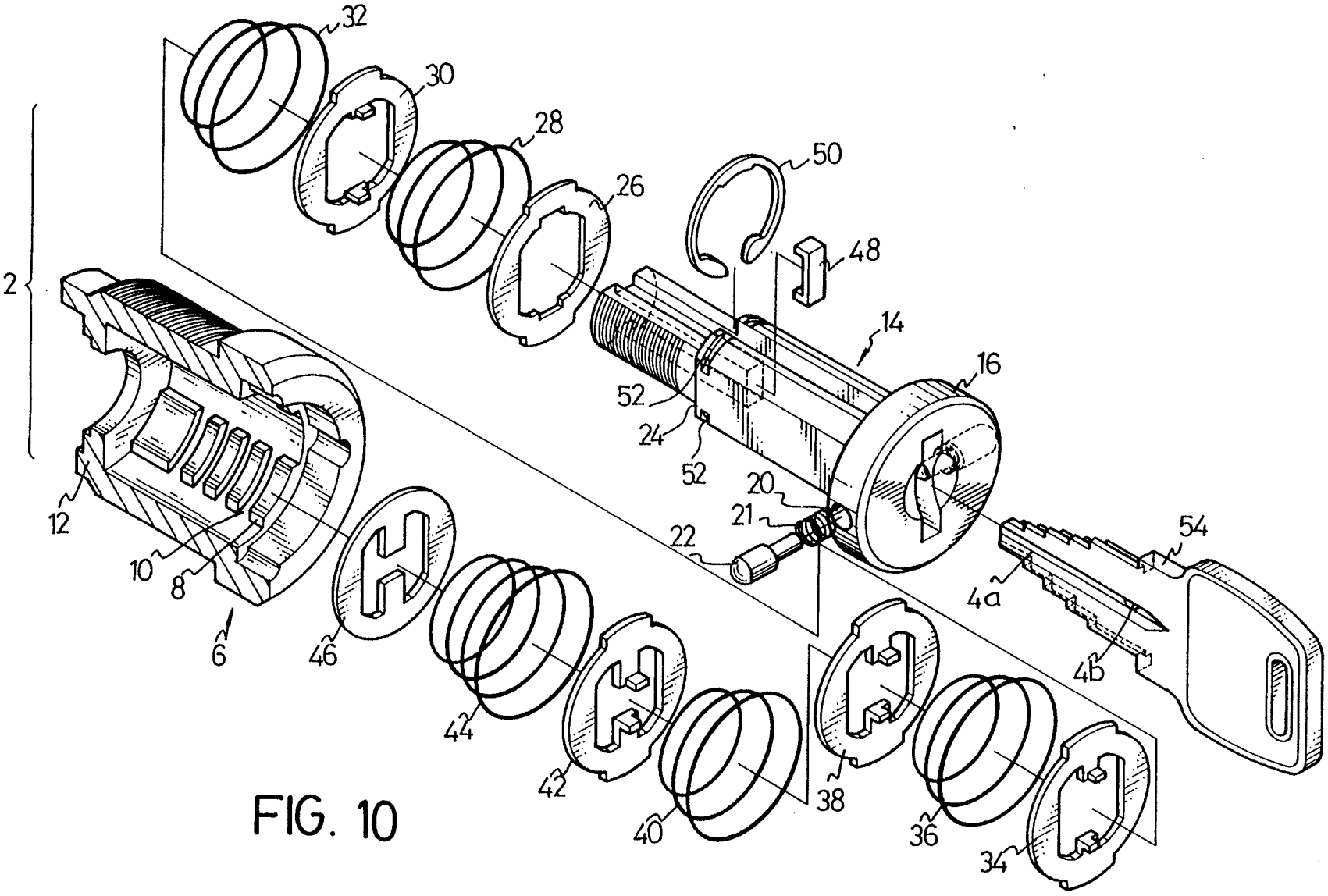
FIG. 10 is an exploded view of a flat lock set consisting of a flat lock and a key in accordance with the seventh embodiment of the present invention.

Additionally referring to FIG. 10 showing a seventh embodiment of the present invention, a flat lock system will be described hereinafter. Hotels each have a lot of rooms each employing a lock set consisting of a unique lock and a corresponding key. Generally, it is preferred that all of the locks employed in the same hotel can be manipulated by means of a master key. Otherwise, it would be troublesome to have that many spare keys for those locks. Therefore, the present invention provides a flat lock system with a master key.

In such a flat lock system, all flat locks, 2 employ the same cylinder 6, i.e., the passages 10 are identically arranged. But, different flat locks 2 have different combinations of lengths of the fingers protruding from the rings 30, 34, 38 and 42. Different combinations of lengths of the fingers protruding from the rings 30, 34, 38 and 42 of another flat lock 2, together with the same arrangement of the passages 10, require different arrangements of the shoulders formed on the keys 4. That is, in the same system, different flat locks 2 require different keys 4.

The flat lock system includes a master key 54 having a number of stepped blades each having a number of shoulders formed thereon. The major difference of the key 54 from the keys 4 is that the shoulders formed on the key 54 abut the arms projecting from the rings 30, 34, 38 and 40 while the shoulders formed on the keys 4 abut the fingers protruding from the rings 30, 34, 38 and 42.

The first section of each of the arms formed on the rings 30, 34, 38 and 42 is wider than the second section of each of the arms formed on the same. That is, the rings 30, 34, 38 and 42 each have a space formed on the arm beside the finger formed thereon.

Furthermore, the stepped blades of the master key 54 are biased from the stepped blades of the keys 4. That is, the shoulders formed on the key 54 abut the spaces formed on the first sections beside the fingers protruding from the rings 30, 34, 38 and 42 when the master key 54 is inserted in the flat locks 2 in the same system.

For each of the rings 30, 34, 38 and 42, the ears are in co-planar with the arms. Therefore, the arrangement of the shoulders formed on the master key 54 depends only upon the arrangement of the passages 10. That is, the ears protruding from the rings 30, 34, 38 and 42 of different flat locks 2 can be caused to align with the passages 10 by the master key 54 pushing the arms formed on the rings 30, 34, 38 and 42. The tumbler 14, together with the latch, is permitted to pivot.

While the present invention has been explained in relation to its preferred embodiment, it is to be understood that variations thereof will be apparent to those skilled in the art upon reading this specification. Therefore, the present invention is intended to cover all such variations as shall fall within the scope of the appended claims.

I claim:

1. A flat lock set comprising a flat lock comprising:

a cylinder comprising a first opening and a second opening and an inner surface formed with a number of groups of ribs, each group including a number of separate ribs defining a number of passages extending perpendicular to a length of the cylinder;

a tumbler comprising a disk integrating with a relatively slender key receiver integrating with a still relatively slender latch carrier, the disk defining a keyhole, the key receiver being separated into a number of prongs by a number of slots;

the disk fitting in the first opening, the key receiver sited in the cylinder, the latch carrier inserted through the second opening;

a number of rings and springs alternatively mounted on the key receiver, the rings each having an outer rim along which a number of ears are formed and an inner rim along which a number of arms are formed, the springs biasing the rings toward the disk so that the ears protruding from the rings are trapped between the ribs; and a key comprising a number of stepped blades each having a number of shoulders formed thereon, the blades of the key being insertable between the prongs of the key receiver so that the shoulders formed thereon push the arms formed on the rings and that the ears protruding from the rings align with the passages.

2. A flat lock set in accordance with claim 1, wherein the arms each comprising a finger perpendicularly projecting therefrom, the arms aligning with one another while the fingers are respectively reachable for the shoulders formed on the key.

3. A flat lock system comprising:

a number of flat locks each comprising:

a cylinder comprising a first opening and a second opening and an inner surface formed with a number of groups of ribs, each group including a number of separate ribs defining a number of passages extending perpendicular to a length of the cylinder;

a tumbler comprising a disk integrating with a relatively slender key receiver integrating with a still relatively slender latch carrier, the disk defining a keyhole, the key receiver separated into a number of prongs by means of a number of slots;

the disk fitting in the first opening, the key receiver sited in the cylinder, the latch carrier inserted through the second opening;

a number of rings and springs alternatively mounted on the key carrier, the rings each having an outer rim from which a number of ears project and an inner rim integrating with a number of co-planar arms each defining a finger perpendicularly protruding therefrom so that a space exists on the arm beside the finger, the springs biasing the rings toward the disk so that the ears are trapped between the ribs, the arms aligning with one another while the fingers are reachable for the shoulders formed on the key;

the flat locks comprising identical cylinders;

a corresponding number of keys each comprising a number of stepped blades each having a number of shoulders formed thereon, the blades of the key being insertable between the prongs of the key receiver so that the shoulders formed thereon pushing the arms formed on the rings and that the ears protruding from the rings align with the passages; and a master key comprising a number of blades each comprising a number of shoulders formed thereon, the shoulders formed on the master key abutting the spaces instead of the fingers being reachable for the shoulders formed on the keys.

* * * * *

UNITED STATES PATENT AND TRADEMARK OFFICE

CERTIFICATE OF CORRECTION

PATENT NO. : 5,335,520

DATED : August 9, 1994

INVENTOR(S) : Miko Lee

It is certified that error appears in the above-identified patent and that said Letters Patent is hereby corrected as shown below:

In Column 3, line 36, after "6", insert i.e.

Signed and Sealed this

Twentieth Day of December, 1994

*Attest:*

*Attesting Officer*

BRUCE LEHMAN

*Commissioner of Patents and Trademarks*